United States Patent [19]

Cichy et al.

[11] B 3,995,835

[45] Dec. 7, 1976

[54] MAGNETIC MIXER

[75] Inventors: Robert D. Cichy, Maumee, Ohio; Anthony P. Schmid, Riga, Mich.; Barry Watson, Toledo, Ohio

[73] Assignee: Owens-Illinois, Inc., Toledo, Ohio

[22] Filed: July 8, 1974

[21] Appl. No.: 486,614

[44] Published under the second Trial Voluntary Protest Program on February 17, 1976 as document No. B 486,614.

[52] U.S. Cl. ..... 259/4 R; 259/DIG. 46

[51] Int. Cl.[2] ..... B01F 13/08

[58] Field of Search ..... 259/4, 1 R, 2, DIG. 46

[56] References Cited

UNITED STATES PATENTS 3,689,033 9/1972 Holmstrom ..... 259/DIG. 46

FOREIGN PATENTS OR APPLICATIONS 991,941 10/1951 France ..... 259/DIG. 46

*Primary Examiner*—Richard E. Aegerter
*Assistant Examiner*—Willis Little
*Attorney, Agent, or Firm*—A. J. Steger; E. J. Holler

[57] ABSTRACT

An inline magnetic mixer for flowing fluids. A magnetic particle is contained within a flow tube through which a fluid passes. A coil made of electrically conductive material is positioned in close proximity to the flow tube and outside the flow tube. A low voltage, oscillating electrical supply energizes the coil. This sets up an oscillating magnetic field within the flow tube which causes the magnetic particle to oscillate longitudinally within the flow tube, thereby mixing the fluid stream passing through the flow tube.

2 Claims, 6 Drawing Figures

MAGNETIC MIXER

BACKGROUND OF THE INVENTION

This invention generally relates to magnetic mixing devices. More specifically, this invention relates to a magnetic mixer of the type wherein a magnetic particle is positioned within a flowing fluid stream. Still more specifically, this invention relates to a magnetic mixer of the type described wherein a coil of conductive material is positioned adjacent to the stream of flowing fluid and is energized by a low voltage oscillating electrical supply to set up an oscillating magnetic field within the flowing stream to thereby oscillate the magnetic particle longitudinally in the flowing stream of fluid.

Magnetic mixers are well known in the art. Examples of such mixers which have a mixing element within the fluid to be mixed may be seen in the following U.S. Pat. Nos. 2,641,452; 3,689,033; and 3,793,886. However, these mixers have not proven completely acceptable in automatic biological fluid measurement systems. In particular, many new devices have been developed for automatic human blood analysis. In these systems, very small blood samples are mixed with buffers, reagents or other fluids. The mixed fluid stream is then subjected to testing for various attributes of the blood sample. These systems are generally designed to be "flow through" type systems to increase the speed of measurement. This requires accurate and repeatable mixing of the blood sample and any other fluid used while these fluids are flowing. Since the sample sizes are usually kept quite small, this requires a small, simple, reliable and, if possible, inexpensive mixing device. Many of the prior art devices operated at relatively high voltages which imparted a very undesirable heating effect to the samples under measurement. We have devised a magnetic mixing device which is quite small, yet reliable and efficient. This device will operate on low voltages and is relatively inexpensive to manufacture.

SUMMARY OF THE INVENTION

Our invention is a magnetic mixing device for mixing a moving fluid stream. The fluid stream passes through a flow tube made of non-magnetic material. A magnetic stirring element is contained within the flow tube. A coil formed of a conductive material is positioned in close proximity to the flow tube. The coil is energized by a means for furnishing a low voltage oscillating electrical supply. This causes generation of an oscillating magnetic field in the flow tube to thereby cause the magnetic element to oscillate longitudinally in the flow tube.

DETAILED DESCRIPTION OF THE DRAWINGS

Figure 1:
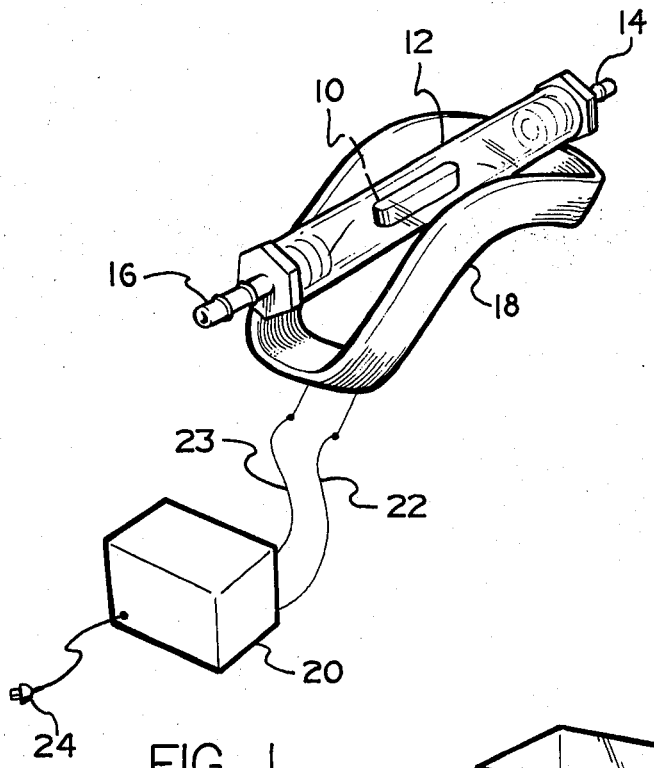
FIG. 1 is a perspective view of one embodiment of the present invention.
Figure 2:
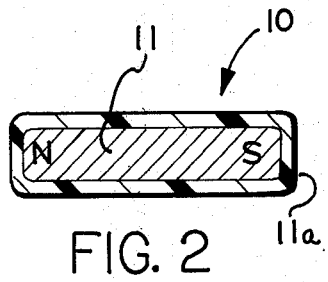
FIG. 2 is a cross sectional view of the magnetic mixing element of the present invention.

In FIG. 1, a magnetic stirring or mixing element 10 is seen as being contained within a mixing tube or flow tube 12. The magnetic element 10 is preferably a particle of ferrite material which is encapsulated with a non-reactive coating such as tetrafluorethylene. The magnetic mixing element 10, as seen in FIG. 2, has an elongated shape. A ferrite bar 11, having north and south magnetic poles, is encapsulated or covered with a non-reactive coating 11a. In operation, the north and south poles are oriented longitudinally of any fluid flow. Since an alternating magnetic field is used, the orientation of a particular pole with respect to upstream or downstream of the fluid flow is not important. The flow tube 12 is preferably a glass tube, but may be made of any non-magnetic material, which allows visual observation of the operation of the magnetic stirring element 10. The flow tube 12 is capped at either end with tubing connectors 14 and 16. The tubing connectors 14 and 16 provide for an inlet and an outlet from the flow tube 12 in which the mixing of the flowing fluid takes place. The tubing connectors 14 and 16 are of a conventional type and the major requirement of these tubing connectors is that their inside diameter which extends into the flow tube 12 be smaller than the magnetic stirring element 10. The coil which makes up the magnetic field generating device of the present invention may be made as a pancake wound coil of approximately three hundred turns of Number 34 enamel coated copper wire. In FIG. 1, the coil is shown as being deformed into a generally saddle-shaped coil 18. The coil 18 is connected to a voltage transformer 20 by electrical conductors 22 and 23. The transformer 20 is connected through an electrical plug 24 to a suitable source of alternating current. The source of alternating current may be a standard household plug furnishing 110 volts at a frequency of 60 cycles per second. However, it is possible to use voltages and frequencies other than those stated with satisfactory results. The transformer 20 is designed to reduce the voltage furnished to it to a voltage between 1 volt and 15 volts, with 3 volts being a preferred operational voltage. The purpose of maintaining the voltage at a relatively low level is to prevent heating of the fluid stream flowing through the flow tube 12. If the voltage furnished to the coil 18 were excessively high, heating of the coil 18 would occur with a consequent transfer of this heat to the fluid stream flowing through the flow tube 12. This is extremely undesirable since some of the materials that are mixed by this apparatus are quite heat-sensitive and their characteristics would be significantly changed if the coil 18 imparted an appreciable degree of heating to them as they were flowing. In operation, the flow tube 12 is allowed to rest on the ends of the saddle-shape coil 18. Thus, when the coil is energized by the transformer 20, a magnetic field is set up within the flow tube 12. This magnetic field then causes the magnetic mixing or stirring element 10 to oscillate rapidly within the tube 12. No attempt is made to control the position or the precise mode of oscillation of the mixing element 10. The movement of the mixing element 10 within the flow tube 12 is generally random in nature, but it has been found to be sufficiently vigorous to mix the materials flowing through the flow tube 12 to the desired degree.

Figure 3:
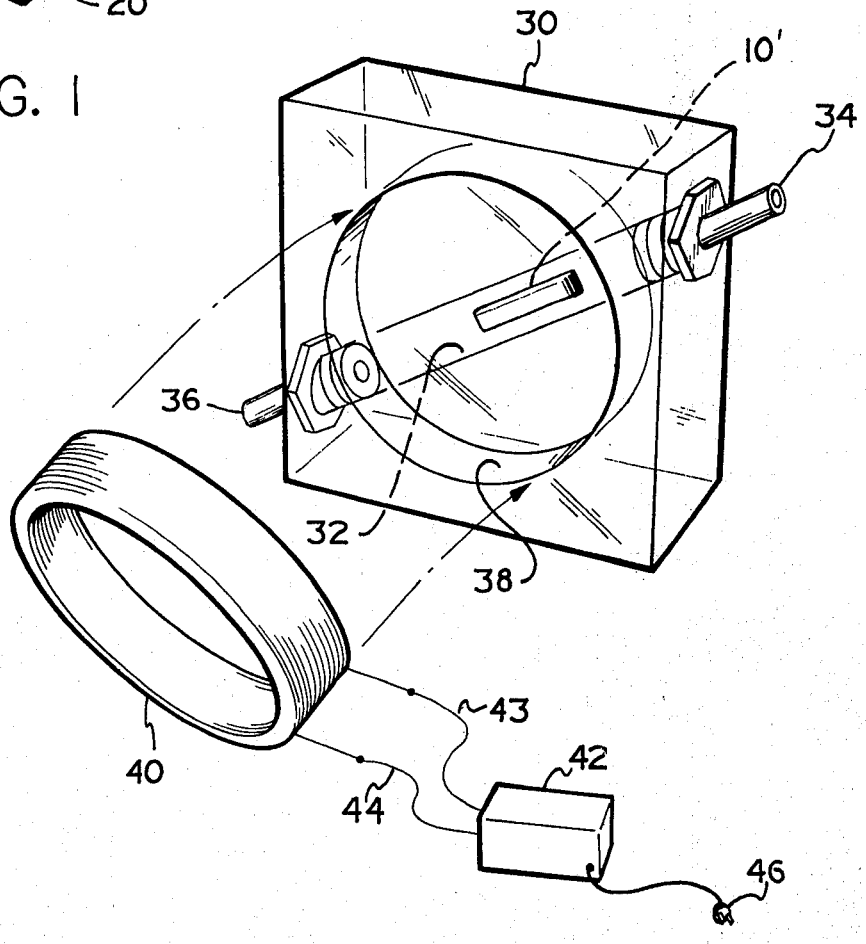
FIG. 3 is a partially exploded perspective view of a second embodiment of the present invention.
Figure 4:
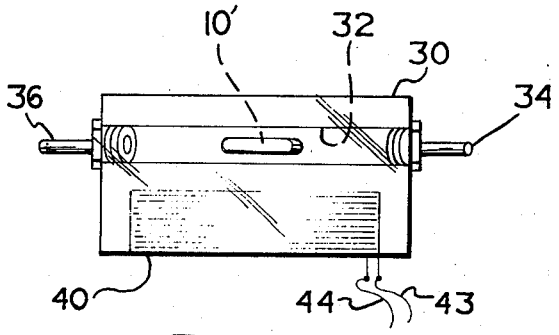
FIG. 4 is a top, plan view of the apparatus of FIG. 2 with the coil in its proper location.

FIGS. 3 and 4 illustrate a slightly modified embodiment of the invention described in FIG. 1. In this case, a clear plastic block 30 has drilled through it an inclined flow tube or flow passage 32. The block 30 is made of a transparent material solely for convenience to allow observation of the mixing action. The flow passage 32 is inclined to prevent formation of air bubbles during the mixing process within the passage 32. A magnetic stirring element 10', which may be identical to the stirring element 10 of FIG. 1, is positioned within the passage 32. Tubing connectors 34 and 36 close off the ends of the inclined passage 32. Tubing connectors 34 and 36 may be identical to the tubing connectors 14 and 16 of FIG. 1. An opening or recess 38 is formed in one side of the block 30. A coil 40 is formed in a manner identical to the coil previously described in FIG. 1, but is deformed into a shape to fit the opening 38 rather than a saddle-shape of the coil 18. The shape of the coil 40 is such that it will fit into the opening 38 cut into the block 30. Note that the opening 38 is not cut deeply enough into the block 30 to enter the passage 32. The coil 40 is connected to a transformer 42 by electrical connectors 43 and 44. The transformer 42 is connected to a source of alternating current through an electrical plug 46. As was the case in FIG. 1, the source of alternating current may be a 110 volt 60 cycle source. However, other voltages and frequencies may be used. The transformer 42 is again used to reduce the voltage furnished from the plug 46 to a range of from 1 to 15 volts, the preferred voltage being 3 volts. This again is for the purpose of preventing heating of the material which might pass through the passage 32. The coil 40 is then inserted into the opening 38 in the block 30. When the coil 40 is energized through the transformer 42, the magnetic stirring element 10' is oscillated longitudinally with respect to the passage 32. As a practical matter, the magnetic stirring element 10' actually assumes a generally equilibrium position approximately midway in the passage 32 and oscillates rapidly about this position. The top view of FIG. 4 illustrates that the opening 38 extends into close proximity to the passage 32 to allow maximum electrical field influence on the stirring element 10'.

Figure 5:
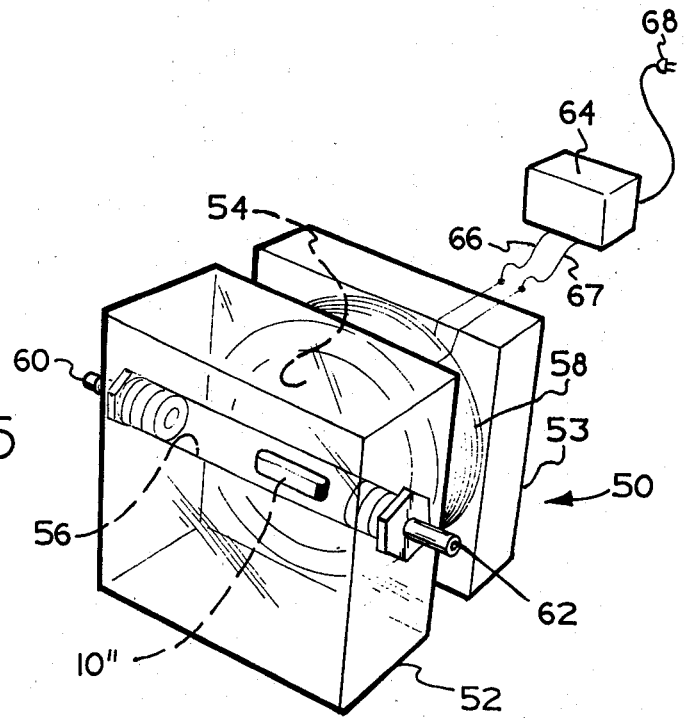
FIG. 5 is a perspective view of a third embodiment of the present invention.
Figure 6:
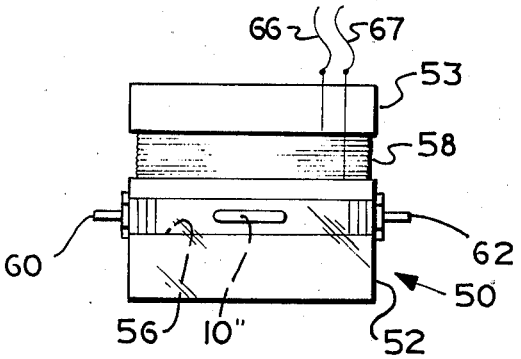
FIG. 6 is a top, plan view of the apparatus of FIG. 4.

FIGS. 5 and 6 illustrate still another embodiment of the present invention. A generally spool-shaped block 50 has two separated end members 52 and 53 connected by a hub member 54. The block 50 is made of a transparent non-magnetic material, the transparency of the material again being a matter of convenience. In this case, a flow tube is defined by a passage 56 which extends completely through the end member 52. A coil 58 is formed by winding approximately three hundred turns of number 34 enamel-coated copper wire around the hub member 54. A magnetic stirring element 10'', which may be identical to the magnetic stirring elements 10 and 10', is positioned in the passage 56. As previously described, the ends of the passage 56 may be fitted with tubing connectors 60 and 62 which maintain the mixing element 10'' in the passage 56 and allow entry and exit of fluids in the passage 56. The coil 58 is connected to a transformer 64 by electrical conductors 66 and 67. The transformer 64 is connected to an alternating electrical supply through a plug 68. As previously explained, the alternating supply may be a 110 volt, 60 cycle source; however, other voltages and frequencies may be used. The transformer 64 furnishes alternating voltage to the coil 58 in the 1 volt to 15 volt range. This creates an oscillating magnetic field in the passage 56 which in turn causes the mixing element 10'' to be oscillated longitudinally in the passage 56. This oscillation provides the desired mixing action. FIG. 6 shows that the passage 56 is formed in the end member 52 in close proximity to the hub member 54. This close relationship allows generation of a sufficient magnetic field in the passage 56 when the coil 58 is energized.

What we claim is:

1. A magnetic mixing device for mixing a moving fluid stream which comprises, in combination:

a block of non-magnetic material, said block including a recess formed in one face thereof and further including a passage extending completely therethrough behind said recess in close proximity thereto but not in communication with said recess, said passage defining a flow tube;

a elongated magnetic stirring element contained within said passage;

means for limiting the travel of said stirring element, in engagement with both ends of said passage, to prevent movement of said stirring element out of said flow tube and to allow movement of said fluid stream through said passage;

a coil formed of electrically conductive material positioned in said recess in said block; and means for furnishing a low voltage oscillating electrical supply to said coil to thereby generate an oscillating magnetic field in said passage for causing said magnetic stirring element to oscillate longitudinally in said passage.

2. A magnetic mixing device for mixing a moving fluid stream which comprises, in combination:

a generally spool-shaped block, formed of a nonmagnetic material, having two separated end members connected by a hub member, said spool-shaped block including a passage extending completely through one of said end members to define a flow tube;

a coil formed of a plurality of turns of a conductive wire wound around said hub member;

an elongated magnetic stirring element contained within said passage;

means for limiting the travel of said stirring element, in engagement with both ends of said passage, to prevent movement of said stirring element out of said flow tube; and means for furnishing a low voltage oscillating electrical supply to said coil to thereby generate an oscillating magnetic field in said passage for causing said magnetic stirring element to oscillate longitudinally in said passage.

* * * * *